US008684667B2

(12) United States Patent
Maruyama

(10) Patent No.: US 8,684,667 B2
(45) Date of Patent: Apr. 1, 2014

(54) LOW PRESSURE STEAM TURBINE

(75) Inventor: Takashi Maruyama, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/433,625

(22) Filed: Mar. 29, 2012

(65) Prior Publication Data

US 2012/0251304 A1 Oct. 4, 2012

(30) Foreign Application Priority Data

Mar. 31, 2011 (JP) ..... 2011-080415

(51) Int. Cl.
*F01D 5/14* (2006.01)

(52) U.S. Cl.
USPC ..... 415/115; 415/116; 415/178

(58) Field of Classification Search
USPC ..... 415/114, 115, 116, 169.2, 169.3, 169.4, 415/177, 178
See application file for complete search history.

(56) References Cited

U.S. PATENT DOCUMENTS

| | | | | |
|---|---|---|---|---|
| 3,997,758 | A * | 12/1976 | Patel | 219/201 |
| 6,230,483 | B1 * | 5/2001 | Sakon et al. | 60/806 |
| 6,851,924 | B2 * | 2/2005 | Mazzola et al. | 415/115 |
| 7,765,807 | B2 * | 8/2010 | Diesterbeck et al. | 60/646 |
| 2009/0249788 | A1 | 10/2009 | Diesterbeck et al. | |
| 2010/0129196 | A1 * | 5/2010 | Johnston et al. | 415/115 |

FOREIGN PATENT DOCUMENTS

| | | |
|---|---|---|
| EP | 1 775 431 | 4/2007 |
| JP | 54-58105 | 5/1979 |
| JP | 1-300002 | 12/1989 |
| JP | 10-103008 | 4/1998 |
| JP | 11-336503 | 12/1999 |
| JP | 2001-55904 | 2/2001 |
| JP | 3617212 | 11/2004 |

OTHER PUBLICATIONS

International Search Report issued May 15, 2012 in corresponding International Application No. PCT/JP2012/056023.
English translation of International Search Report issued May 15, 2012 in corresponding International Application No. PCT/JP2012/056023.
English translation of Japanese Patent Application Publication No. 2001-55904, published Feb. 27, 2001.
English translation of Japanese Patent Application Publication No. 11-336503, published Dec. 7, 1999.

(Continued)

*Primary Examiner* — Edward Look
*Assistant Examiner* — Aaron R Eastman
(74) *Attorney, Agent, or Firm* — Wenderoth, Lind & Ponack, L.L.P.

(57) ABSTRACT

A low-pressure steam turbine includes an inner casing, an outer casing arranged outside the inner casing so as to cover the inner casing, a heat carrier heating channel between the inner casing and the outer casing so that a heat carrier flows therethrough, a heat carrier inlet passage for introducing the heat carrier into the heat carrier heating channel, and a heat carrier chamber in the inside of at least one of stationary blades to receive the heat carrier that has passed through the heat carrier heating channel. The at least one of stationary blades is heated by the heat carrier which has been heated by passing through the heat carrier heating channel.

9 Claims, 5 Drawing Sheets

(56) References Cited

OTHER PUBLICATIONS

Notice of Preliminary Rejection issued Aug. 26, 2013 in corresponding Korean Application No. 10-2013-7016776 (with English translation).

Decision to grant a patent issued Jul. 3, 2012 in corresponding Japanese Application No. 2011-080415 (with English translation).

International Preliminary Report on Patentability and Written Opinion of the International Searching Authority issued Oct. 2, 2013 in corresponding International Application No. PCT/JP2012/056023 (with English translation).

Notice of Allowance issued Nov. 26, 2013 in corresponding Korean Application No. 10-2013-7016776, with English translation.

Office Action issued Dec. 4, 2013 in corresponding Chinese Patent Application No. 201280004352.3 (with English translation).

* cited by examiner

LOW PRESSURE STEAM TURBINE

BACKGROUND OF THE INVENTION

I. Technical Field

This invention relates to a low-pressure steam turbine for use in thermal and nuclear power plants.

II. Description of the Related Art

A low-pressure steam turbine used in a thermal power plant or nuclear power plant is driven under wet steam condition in the vicinity of its final stage. Under the wet steam condition, there occurs wet loss, that is thermodynamic and hydrodynamic energy loss, along with generation or growth of drain, and the turbine efficiency is deteriorated. If the drain collides against turbine moving blades rotating at a high speed, the blade surfaces will be possibly subject to erosion, resulting in deterioration of reliability of the turbine.

As a measure for reducing wet loss and preventing erosion in a low-pressure steam turbine, a conventional technique is known in which drain is removed by means of a drain catcher or hollow stationary blades. As a technique of using a drain catcher in a low-pressure steam, Japanese Patent Application Publication No. 2001-55904 listed below, for example, discloses a technique in which a drain catcher is provided on a stationary blade outer ring supporting stationary blades. According to the technique disclosed in Japanese Patent Application Publication No. 2001-55904, drain contained in turbine driving steam is caught with the drain catcher, and the caught drain is discharged outside through a passage. Further, as a technique of using hollow stationary blades in a low-pressure steam turbine, Japanese Patent Application Publication No. H11-336503, for example discloses steam turbine stationary blades, in which each stationary blade has a cavity passing from an outer shroud to an inner shroud through the inside of the stationary blade. The stationary blade also has a plurality of slits which connect the front-side and back-side surfaces of the stationary blade to the cavity and extend vertically while being spaced from each other by a predetermined distance. The stationary blades of the steam turbine disclosed in Japanese Patent Application Publication No. H11-336503 are able to introduce drain into the cavities inside the stationary blades through the slits and collect the drain from the cavities.

Further, as another measure for reducing wet loss and preventing erosion, there is known a conventional technique in which stationary blades are heated by introducing steam into the inside of the stationary blades from the outside in order to prevent condensation of steam on the surfaces of the stationary blades. Japanese Patent No. 3617212, for example, discloses a technique of heating stationary blades, in which leakage steam at high temperature and low pressure is extracted from a shaft seal gasket upstream of a high-pressure stage of the turbine and is introduced into hollow stationary blades.

However, even though the technique of using a drain catcher as disclosed in Japanese Patent Application Publication No. 2001-55904 or the technique of using hollow stationary blades as disclosed in Japanese Patent Application Publication No. H11-336503 are able to realize reduction of wet loss and prevention of erosion by removing drain, they still have a problem that turbine driving steam may possibly be discharged together with the drain. As for the technique of heating stationary blades as disclosed in Japanese Patent No. 3617212, steam must be introduced from the outside as energy for heating the stationary blades. This means that the system as a whole requires introduction of energy from the outside. It may be also possible to heat the stationary blades with use of a heater instead of externally introducing steam. In this case, however, additional energy is required to drive the heater. Therefore, the system as a whole requires introduction of energy from the outside.

SUMMARY OF THE INVENTION

In view of the foregoing problems inherent to the prior art, an object of this invention is to provide a low-pressure steam turbine which is capable of reducing wet loss and preventing erosion by heating a stationary blade in the vicinity of a final stage without discharging steam for driving together with drain and without the need of introduction of energy from the outside.

In order to solve the aforementioned problems, this invention provides a low-pressure steam turbine including an inner casing that houses a rotor having a plurality of moving blades fixed thereto and includes a plurality of stationary blades fixed in the inside of the inner casing, and an outer casing arranged outside the inner casing so as to cover the inner casing. The low-pressure steam turbine of the invention is characterized by further including: a heat carrier heating channel provided between the inner casing and outer casing so that a heat carrier flows therethrough; a heat carrier inlet passage for introducing the heat carrier into the heat carrier heating channel; and a heat carrier chamber provided in the inside of at least one of the stationary blades to receive the heat carrier that has passed through the heat carrier heating channel, and characterized in that the at least one of stationary blades in which the heat carrier chamber is provided is heated by the heat carrier which has been heated by passing through the heat carrier heating channel.

An exhaust chamber is formed between the inner casing and the outer casing for guiding steam, which has performed work in the low-pressure steam turbine, to a condenser provided separately. This means that there exists, between the inner casing and the outer casing, the steam which has performed work in the low-pressure steam turbine. On the other hand, part of heat possessed by high-temperature steam within the inner casing (especially near the steam inlet) is emitted via the inner casing and transferred to the exhaust. Conventionally, the heat transferred to the exhaust is discharged together with the exhaust without being used. In this invention, the heat carrier heating channel is provided between the inner casing and the outer casing so that a heat carrier flowing through the heat carrier heating channel is heated by exchanging heat with steam which has performed work in the low-pressure steam turbine and obtained thermal energy corresponding to the aforementioned emitted heat.

The thermal energy corresponding to the emitted heat is conventionally discharged together with exhaust without being used. According to this invention, the thermal energy corresponding to the emitted heat that has conventionally not been used is utilized, whereby the heat carrier can be heated without introducing energy from the outside. The heated heat carrier is introduced into the heat carrier chamber provided in a stationary blade to heat the stationary blade, whereby condensation of steam on the surface of the stationary blade can be prevented, making it possible to reduce wet loss and prevent erosion. This means that the usage of the thermal energy corresponding to the emitted heat makes it possible to heat the stationary blade without introducing energy from the outside. In addition, according to the invention, condensation of steam on the surface of the stationary blade is prevented and occurrence of drain is prevented by heating the stationary blade, and therefore no steam for driving is discharged.

The inner casing may be formed of a wall member, and the stationary blades may be supported on the inside of the wall member via blade rings.

Known structures for an inner casing for a low-pressure steam turbine include a single-wall inner casing structure formed by a wall member having stationary blades supported on the inside thereof via blade rings, and a double-wall inner casing structure in which the inner casing has a double structure consisting of a first linner casing and a second inner casing and an extraction steam chamber is provided between the first inner casing and the second inner casing.

In the single-wall inner casing structure, the amount of heat that is possessed by driving steam flowing within the inner casing and is emitted to between the inner casing and the outer casing through the wall of the inner casing is greater in comparison with the double-wall inner casing structure. In other words, more energy is lost. On the other hand, the single-wall inner casing structure is simpler in structure than the double-wall inner casing structure, and hence the manufacturing cost and maintenance cost are less expensive.

The formation of the inner casing into a single-wall inner casing structure makes it possible to reduce the manufacturing cost and maintenance cost of the inner casing. Further, the heat emitted through the wall of the inner casing, that has conventionally been discharged, can be reused to heat the heat carrier in the heat carrier heating channel. Therefore, the thermal energy loss of the low-pressure steam turbine as a whole can be reduced.

The stationary blade having the heat carrier chamber provided therein has a slit for injecting the heat carrier from the heat carrier chamber to the outside of the stationary blade, the heat carrier is water, which is transformed into steam by passing through the heat carrier heating channel and introduced into the heat carrier chamber.

The formation of the slit to inject the heat carrier from the heat carrier chamber to the outside of the stationary blade eliminates the need of providing a channel for discharging from the heat carrier chamber the heat carrier which has been introduced into the heat carrier chamber. Further, the heat carrier introduced into the heat carrier chamber is transformed into steam, whereby the heat carrier can be injected to the outside of the stationary blade through the slit without the heat carrier forming a contaminant in the inner casing. Furthermore, the steam functioning as the heat carrier is injected through the slit, whereby the steam is allowed to perform work on the moving blades.

The heat carrier inlet passage is a condensate inlet passage for introducing, into the heat carrier heating channel, condensate obtained by condensing vapor which has been used to generate work in the low-pressure steam turbine, and the condensate may be used as the heat carrier.

The use of the condensate as the heat carrier eliminates the need of preparing a heat carrier separately in addition to a carrier required for driving the low-pressure steam turbine.

The low-pressure steam turbine may further include: a stationary blade surface temperature detection unit which detects a surface temperature of the at least one of stationary blades in which the cavity is provided; a steam pressure detection unit which detects a steam pressure on the upstream side of the at least one of stationary blades in which the heat carrier chamber is provided; and a heat exchange amount regulating unit which regulates an amount of heat exchanged based on a difference between a temperature detected by the stationary blade surface temperature detection unit and a saturated steam temperature at a detected pressure by the steam pressure detection unit.

In order to prevent condensation of steam on the surface of the stationary blade by heating the stationary blade, it is necessary to maintain the surface temperature of the stationary blade higher than the saturated steam temperature corresponding to the steam pressure around the stationary blade. For this purpose, the heat exchange amount regulating unit is provided so that the heat exchange amount by the heat exchange unit is regulated based on a difference between a temperature detected by the stationary blade surface temperature detection unit and a saturated steam temperature at a detected pressure by the steam pressure detection unit. In this manner, the surface temperature of the stationary blade is maintained higher than the saturated steam temperature corresponding to the steam pressure around the stationary blade, whereby condensation of steam on the surface of the stationary blade can be prevented.

The heat exchange amount regulating unit may include: a heat carrier flow regulating valve provided in the heat carrier inlet passage; and a regulating valve control unit which regulates opening of the heat carrier flow regulating valve based on the difference between the temperature detected by the stationary blade surface temperature detection unit and the saturated steam temperature at the detected pressure by the steam pressure detection unit.

This makes it possible to regulate the heating amount for the heat carrier in the heat carrier heating channel by regulating the opening of the heat carrier flow regulating valve to regulate the amount of the heat carrier introduced into the heat carrier heating channel.

Further, a plurality of the heat carrier heating channels may be provided. The heat carrier inlet passage may be branched in midway into a plurality of branched inlet passages, and the branched inlet passages may be connected to the plurality of heat carrier heating channels, respectively. The heat exchange amount regulating unit may include: branched inlet passage heat carrier flow regulating valves provided in the respective branched inlet passages; and a branched passage regulating valve control unit which regulates opening of the branched inlet passage heat carrier flow regulating valves based on the difference between the temperature detected by the stationary blade surface temperature detection unit and the saturated steam temperature at the detected pressure by the steam pressure detection unit.

This configuration makes it possible to regulate the flow rates of the heat carrier to the branched inlet passages by regulating the openings of the branched inlet passage heat carrier flow regulating valves to regulate the amounts of the heat carrier fed to the branched inlet passages. Further, the openings of some of the branched inlet passage heat carrier flow regulating valves can be reduced to zero so that the number of the heat carrier heating channels used to heat the heat carrier is changed. Thus, the area of heat exchange surface where the heat carrier exchanges heat can be changed and the heating amount for the heat carrier in the heat carrier heating channel can be regulated.

The heat carrier heating channel may be provided surrounding an upper half of the inner casing.

In the upper half of the inner casing, the amount of heat emitted through the inner casing is greater than in the lower half of the inner casing. Therefore, the provision of the heat carrier heating channel surrounding the upper half of the inner enables the heat carrier to be heated more efficiently. In addition, the lower half of the inner casing is generally provided with more accessories including an extraction steam pipe and so on. Therefore, the attachment of the heat carrier heating channel can be made easier when the heat carrier heating channel is attached to the upper half of the inner casing having fewer accessories attached thereto.

The heat carrier heating channel may be provided surrounding a steam inlet of the inner casing.

The steam flowing in the inside of the steam inlet is steam which has not been used to perform work in the low-pressure steam turbine. In other words, the steam flowing in the inside of the steam inlet is steam having the highest temperature in the steam flowing within the inner casing. Therefore, a great amount of heat is emitted from the steam inlet to the outside of the inner casing, and hence the provision of the heat carrier heating channel surrounding the steam inlet enables the heat carrier to be heat efficiently.

This invention is able to provide a low-pressure steam turbine which is capable of reducing wet loss and preventing erosion by heating the stationary blade in the vicinity of the final stage without introducing energy from the outside and without discharging driving steam together with drain.

DETAILED DESCRIPTION OF THE INVENTION

Preferred embodiments of the invention will be described in detail by way of example with reference to the drawings. It should be understood that dimensions, materials, shapes, and relative arrangement of parts and components described in these embodiments are provided for an illustrative purpose only and are not intended to limit the scope of the invention unless otherwise stated.

EMBODIMENTS

First Embodiment

Figure 1:
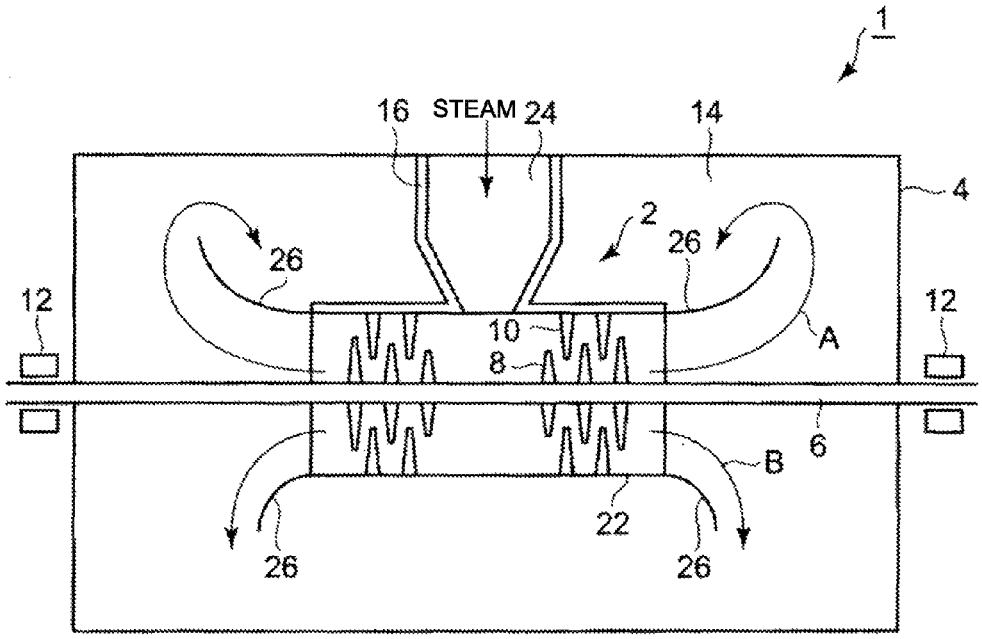
FIG. 1 is a schematic configuration diagram illustrating a configuration of a low-pressure steam turbine according to a first embodiment.

Referring to FIG. 1, a configuration of a low-pressure steam turbine will be schematically described.

FIG. 1 is a schematic configuration diagram illustrating a configuration of a low-pressure steam turbine according to a first embodiment of the invention. The low-pressure steam turbine 1 has an inner casing 2, and an outer casing 4 arranged outside the inner casing 2 so as to cover the inner casing 2. A space 14 is formed between the inner casing 2 and the outer casing 4.

The inner casing 2 is configured to include an inner casing body 22 housing a rotor 6, a steam inlet 24 for introducing steam into the inner casing body 22 from the outside, and a flow guide 26 for guiding flow of the steam that has been used to generate work in the inner casing body 22. The inner casing 2 is of a single-wall inner casing structure.

The rotor 6 is rotatably supported by a bearing 12 outside the outer casing 4. A plurality of moving blades 8 are implanted in and fixed to the rotor 6. The portion of the rotor 6, where the moving blades are implanted and the moving blades 8, are housed in the inner casing body 22.

In the inner casing body 22, a plurality of stationary blades 10 are attached via blade rings 11 (not shown in FIG. 1) so as to face the moving blades 8 arranged on the rotor 6.

The configuration of this invention is further characterized by a heat exchanger panel 16 provided surrounding an upper half of the inner casing 2. The heat exchanger panel 16 is a channel in which a heat carrier (that is condensate to be described later in the first embodiment) flows, and is made of a material capable of exchanging heat with the outside of the channel. This means that the heat exchanger panel 16 is provided for causing the heat carrier flowing within the heat exchanger panel 16 to exchange heat with the surroundings of the heat exchanger panel 16.

Figure 2:
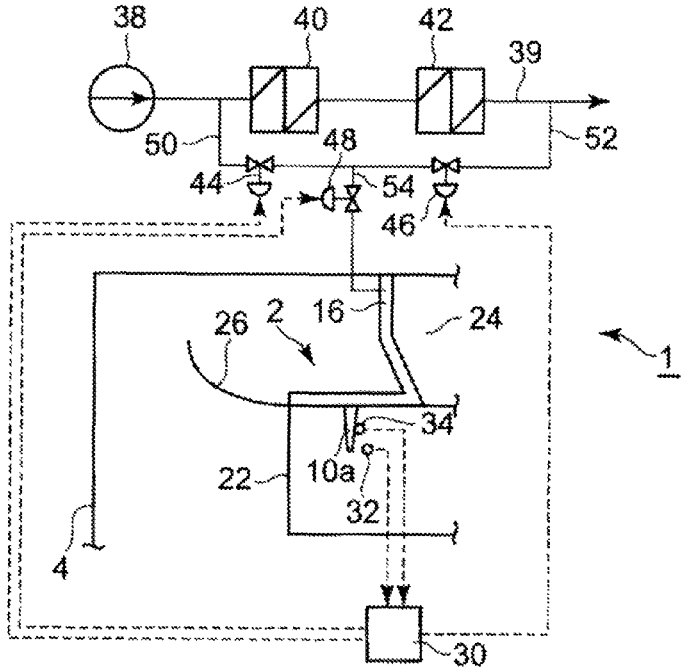
FIG. 2 is a schematic configuration diagram illustrating surroundings of a heat exchanger panel according to the first embodiment.
Figure 3:
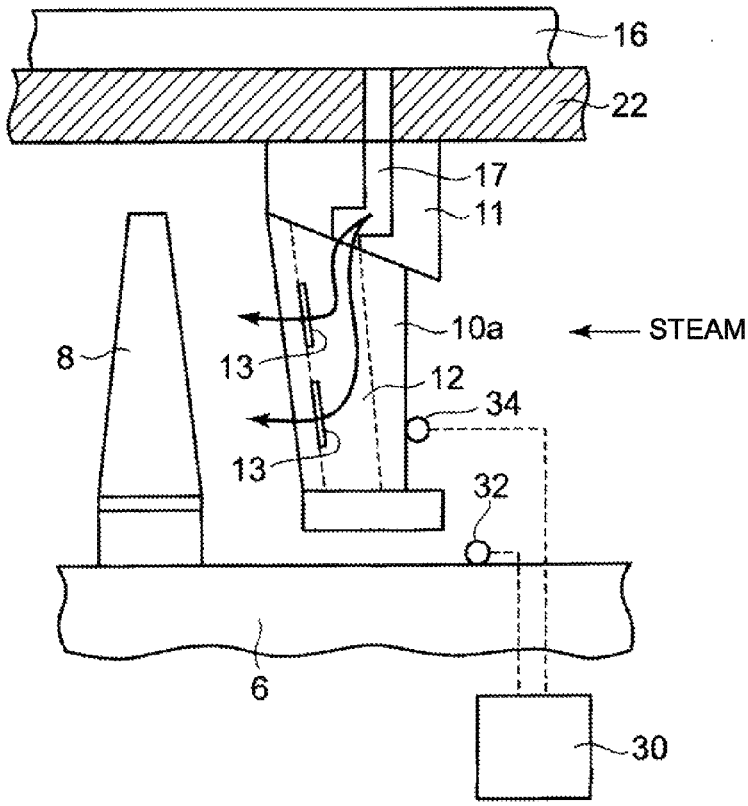
FIG. 3 is a schematic configuration diagram illustrating surroundings of a final stage stationary blade according to the first embodiment.

A configuration around the heat exchanger panel 16 and operation thereof will be described with reference to FIGS. 1 to 3. FIG. 2 is a schematic configuration diagram showing surroundings of the heat exchanger panel according to the first embodiment. FIG. 3 is a schematic configuration diagram showing surroundings of the final stage stationary blade according to the first embodiment.

In FIG. 2, reference numeral 38 denotes a condensate pump. The condensate pump 38 is a pump for feeding condensate to the next stage. The condensate is condensed by a condenser (not shown) isobarically cooling vapor which has been used to generate work in the low-pressure steam turbine 1. The condensate pump 38 is provided outside the low-pressure steam turbine 1.

The condensate fed by the condensate pump 38 flows through a condensate channel 39, being heated by two low-pressure feedwater heaters 40 and 42 arranged in series on the condensate channel 39, and is fed to the next stage.

An upstream condensate inlet passage 50 is formed by being branched from the condensate channel 39 downstream of the condensate pump 38 and upstream of the low-pressure feedwater heater 40, while a downstream condensate inlet passage 52 is formed by being branched from the condensate channel 39 downstream of the low-pressure feedwater heater 42. The upstream condensate inlet passage 50 and the downstream condensate inlet passage 52 merge together to form a condensate inlet passage 54, and the condensate inlet passage 54 is connected to the heat exchanger panel 16.

The upstream condensate inlet passage 50, the downstream condensate inlet passage 52, and the condensate inlet passage 54 are respectively provided with control valves 44, 46 and 48 for regulating the fluid flow rate therein. Opening of each of the control valves 44, 46 and 48 is regulated by a control device 30 to be described later.

FIG. 2 and FIG. 3 illustrate a final stage stationary blade 10*a* that is one of a plurality of stationary blades provided in the low-pressure steam turbine 1. The final stage stationary blade 10*a* is located at the most downstream in the flow direction of steam within the inner casing body 22. A stationary blade surface temperature gauge 34 is attached to the final stage stationary blade 10*a* for detecting a surface temperature thereof. Further, a steam pressure gauge 32 for detecting a steam pressure is provided upstream in the steam flow direction in the final stage stationary blade 10*a*. The detected values by the stationary blade surface temperature gauge 34 and the steam pressure gauge 32 are input to the control device 30.

The final stage stationary blade 10*a* has a hollow shape as shown in FIG. 3, and a heat carrier chamber 12 is formed therein. The heat carrier chamber 12 communicates with the heat exchanger panel 16 through the wall of the inner casing body 22 and a stationary blade inlet passage 17 passing through the inside of the blade ring 11. This makes it possible to introduce condensate, which has been heated and evaporated while passing through the heat exchanger panel 16, into the heat carrier chamber 12 within the final stage stationary blade 10*a*.

It is preferable in terms of heat exchange efficiency to extend the heat exchanger panel 16 from the steam inlet 24 to a stationary blade in an intermediate stage.

The final stage stationary blade 10*a* is provided with slits 13 connecting the heat carrier chamber 12 to the outside of the stationary blade 10*a*. The slits 13 are provided downstream of the final stage stationary blade 10*a* in the flow direction of steam flowing in the inner casing body 22.

Next, operation of the low-pressure steam turbine 1 having the configuration as described above will be described.

In the low-pressure steam turbine 1, steam introduced from the outside is introduced into the inner casing body 22 through the steam inlet 24. The steam introduced into the inner casing body 22 is expanded and increased in flow speed while passing through the stationary blade 10, and works on the moving blades 8 to cause the rotor 6 to rotate.

The steam which has performed work in the inner casing body 22 is discharged from the inner casing body 22 into the space 14. Part of the steam discharged into the space 14 flows upward of the inner casing body 22 along the flow guide 26 as indicated by the flow direction A in FIG. 1, and then flows downward along the periphery of the inner casing body 22. Another part of the steam is discharged out of the outer casing 4 through a discharge portion (not shown) provided in a lower part of the outer casing 4, and then fed to the condenser (not shown). On the other hand, the remainder of the steam discharged into the space 14 flows downward in the space 14 along the flow guide 26 as indicated by the flow direction B in FIG. 1, and discharged out of the outer casing 4 through a discharge portion (not shown) provided in a lower part of the outer casing 4, and then fed to the condenser (not shown).

Figure 4:
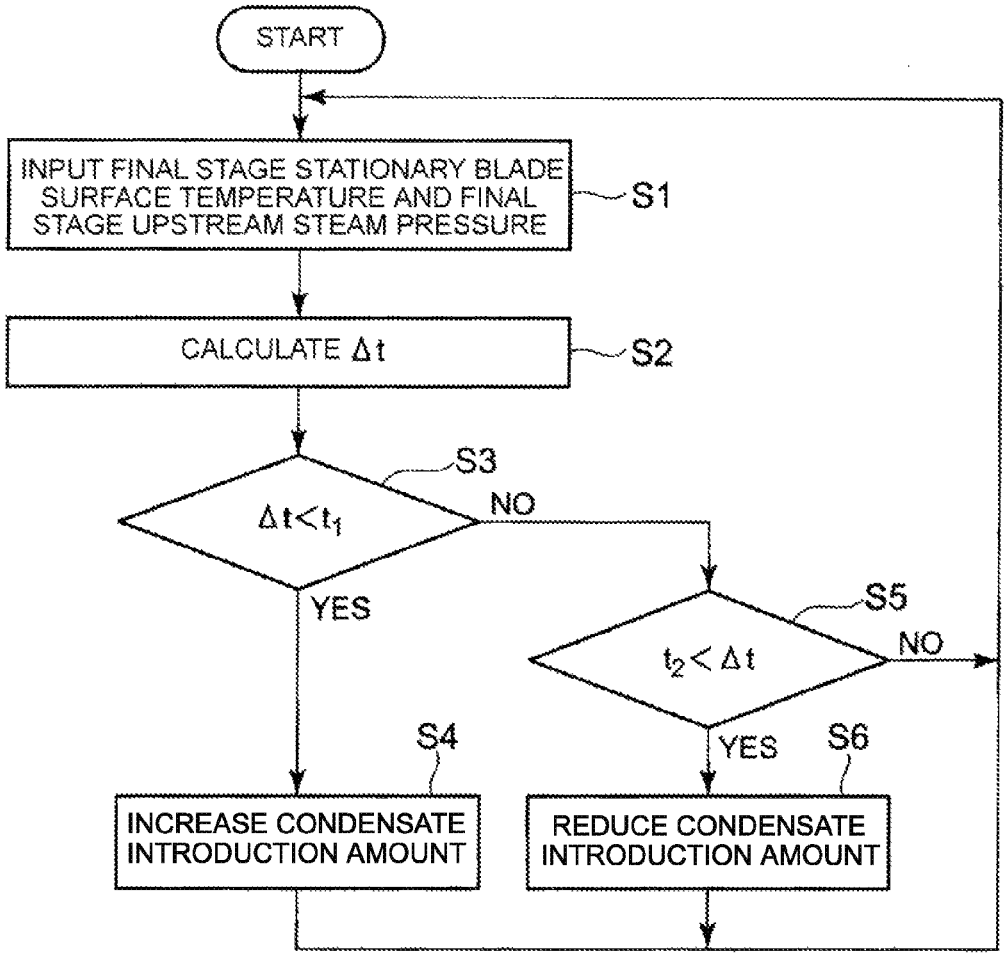
FIG. 4 is a flowchart illustrating procedures for controlling introduction of condensate for the purpose of heating a final stage stationary blade according to the first embodiment.

In the meantime, the control device 30 controls the introduction of condensate into the heat carrier chamber 12 within the final stage stationary blade 10*a*. This control will be described with reference to FIG. 4. FIG. 4 is a flowchart illustrating procedures for controlling the introduction of condensate for heating the final stage stationary blade in the first embodiment of the invention.

Once the low-pressure steam turbine 1 is driven, the operation proceeds to step S1.

In step S1, a detected value by the stationary blade surface temperature gauge 34 attached to the final stage stationary blade 10*a* (hereafter, referred to as the final stage stationary blade surface temperature) is input to the control device 30, while at the same time a detected value by the steam pressure gauge 32 attached upstream of the final stage stationary blade 10*a* in the steam flow direction (hereafter, referred to as the final stage upstream steam pressure) is input to the control device 30.

Subsequently, the operation proceeds to step S2.

In step S2, based on the final stage upstream steam pressure, the control device 30 computes a saturated steam temperature at this pressure. The control device 30 then calculates a temperature difference Δt between the saturated steam temperature and the final stage stationary blade surface temperature. It is assumed here that Δt denotes a difference obtained by subtracting the saturated steam temperature from the final stage stationary blade surface temperature.

Subsequently, the operation proceeds to step S3.

In step S3, it is determined whether or not the value Δt is smaller than a predetermined threshold t1. The threshold t1 is a positive value.

If it is determined "Yes" in step S3, that is, if $\Delta t < t1$, it means that the final stage surface temperature has not been sufficiently raised, and steam is likely to condense on the surface of the final stage stationary blade 10*a*. Therefore, the operation proceeds to step S4.

In contrast, if it is determined "No" in step S3, that is, if $\Delta t \geq t1$, it means that the final stage stationary blade surface temperature is sufficiently raised, and the possibility is low that the steam condenses on the surface of the final stage stationary blade 10*a*. Therefore, the operation proceeds to step S5.

In step S4, based on the temperature difference Δt, the control device 30 fully opens the control valve 48, while increasing the opening of the control valve 44 or 46. This increases the amount of condensate flowing through the condensate channel 39 and introduced into the heat exchanger panel 16 through the condensate inlet passage 54.

When the final stage stationary blade surface temperature is lower than the saturated steam temperature, like when the temperature difference Δt assumes a negative value, the openings of the control valves 44 and 46 are regulated such that the opening of the control valve 46 is greater than that of the control valve 44 so that a greater amount of condensate of a higher temperature that has been heated by the low-pressure feedwater heaters 40 and 42 is introduced into the heat exchanger panel 16. Conversely, when Δt is a value close to t1, the openings of the control valves 44 and 46 are regulated such that the opening of the control valve 44 is greater than the opening of the control valve 46.

The condensate introduced into the heat exchanger panel 16 through the condensate inlet passage 54 exchanges heat with the outside of the heat exchanger panel 16, that is, with steam within the space 14, while flowing through the inside of the heat exchanger panel 16, whereby the condensate is heated and transformed into steam. The condensate, that has been transformed into steam in the heat exchanger panel 16, is introduced into the heat carrier chamber 12 provided in the final stage stationary blade 10*a* through the stationary blade inlet passage 17. The final stage stationary blade 10*a* is heated by the evaporated condensate introduced into the heat carrier chamber 12.

Once step S4 is finished, operation returns to step S1.

The steam introduced into the heat carrier chamber 12 is injected into the outside, that is, into the inner casing body 22 through the slit 13. This eliminates the need of providing a system for discharging the evaporated condensate. Furthermore, the evaporated and injected condensate can perform work on the moving blades.

On the other hand, in step S5, it is determined whether or not Δt is smaller than a predetermined threshold t2. The threshold t2 is set to a greater value than t1.

If it is determined "Yes" in step S5, that is, if $t2 < \Delta t$, it means that the final stage stationary blade surface temperature is raised excessively, and hence the operation proceeds to step S6. If it is determined "No" in step S5, that is, if $t2 \geq \Delta t$, the operation returns to step S1.

In step S6, the opening of the control valve 44 or 46 is decreased to reduce the amount of the condensate introduced into the heat exchanger panel 16.

Once step S6 is finished, the operation returns to step S1.

During operation of the low-pressure steam turbine 1, the foregoing steps S1 to S6 are repeated so that the amount of heat carrier (evaporated condensate) introduced into the heat carrier chamber 12 is regulated. This makes it possible to maintain the condition in which $t1 \leq \Delta \leq t2$, that is, the condition in which the final stage stationary blade surface temperature is higher than the saturated steam temperature by t1 to t2.

In this manner, the condensation of steam on the surface of the final stage stationary blade 10*a* can be prevented, which makes it possible to reduce wet loss and prevent erosion.

The stationary blade which is provided with the heat carrier chamber 12 and into which the condensate that has been evaporated by being heated in the heat exchanger panel 16 is introduced is not limited to the final stage stationary blade like in the first embodiment. The heat carrier chamber can be provided in each of a plurality of the stationary blades including the final stage stationary blade, and evaporated condensate can be introduced into the plurality of heat carrier chambers.

Second Embodiment

Figure 5:
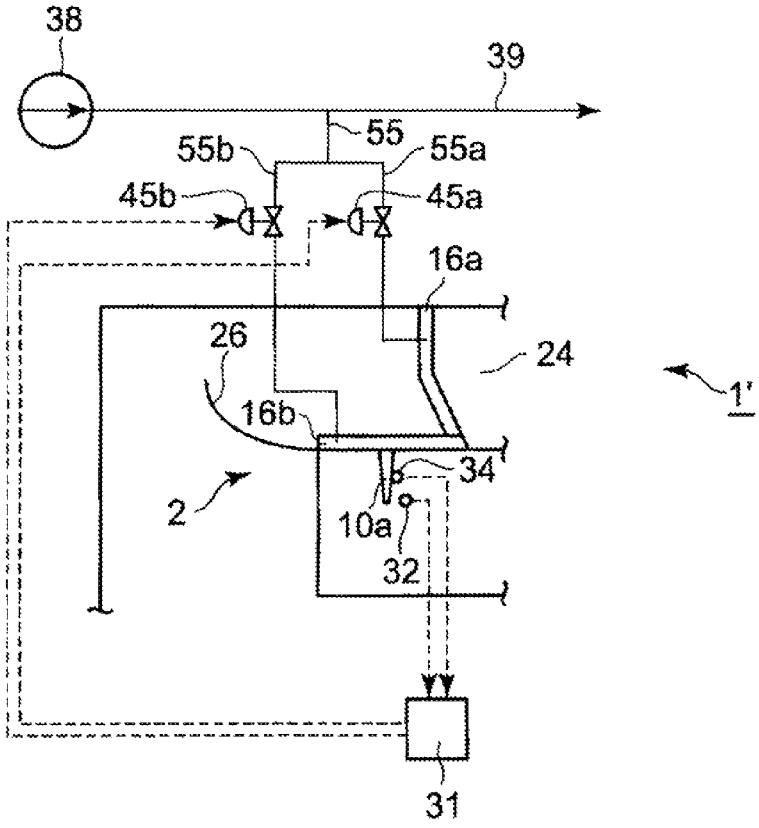
FIG. 5 is a schematic configuration diagram illustrating surroundings of a heat exchanger panel according to a second embodiment.

FIG. 5 is a schematic configuration diagram illustrating surroundings of a heat exchanger panel according to a second embodiment of the invention. In FIG. 5, the same components as those of FIG. 1 to FIG. 3 are assigned with the same reference numerals, and description thereof will be omitted.

As shown in FIG. 5, a first heat exchanger panel 16*a* is provided surrounding a steam inlet 24 forming an inner casing 2, and a second heat exchanger panel 16*b* is provided surrounding an upper half of the inner casing body 22. Both of the heat exchanger panels 16*a* and 16*b* are channels for passing a heat carrier (condensate to be described later, according to the second embodiment) through, and are formed of a material which is able to exchange heat with the outside of the channel.

A condensate inlet passage 55 is formed by being branched from the condensate channel 39 on the downstream side of the condensate pump 38. The condensate inlet passage 55 is branched, in its midway, into two branched inlet passages 55*a* and 55*b*. These two branched inlet passages 55*a* and 55*b* are connected to the heat exchanger panels 16*a* and 16*b*, respectively.

The branched inlet passages 55*a* and 55*b* are respectively provided with control valves 45*a* and 45*b* for regulating the flow rate of fluid flowing therethrough. Openings of the control valves 45*a* and 45*b* are both regulated by a control device 31 to be described later. Detected values by a stationary blade surface temperature gauge 34 and a steam pressure gauge 32 are transmitted to the control device 31.

Figure 6:
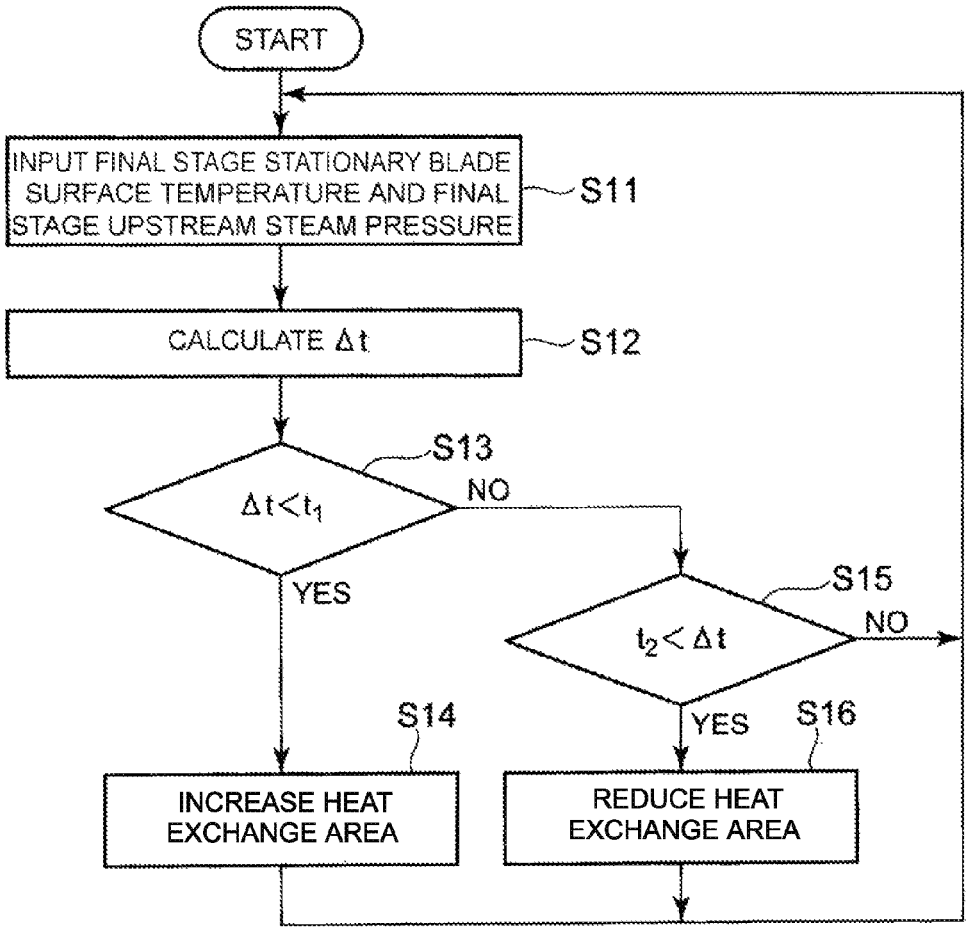
FIG. 6 is a flowchart illustrating procedures for controlling introduction condensate for the purpose of heating a final stage stationary blade according to the second embodiment.

Operation of a low-pressure steam turbine 1' configured as described above will be described with reference to FIG. 6.

In step S11, the control device 31 receives a final stage stationary blade surface temperature value that is a detected value by the stationary blade surface temperature gauge 34, while receiving a final stage upstream steam pressure value that is a detected value by the steam pressure gauge 32.

The operation then proceeds to step S12.

In step S12, the control device 31 computes, based on the final stage upstream steam pressure, a saturated steam temperature at this pressure. The control device 31 then calculates a temperature difference $\Delta t$ between the saturated steam temperature and the final stage stationary blade surface temperature.

The operation proceeds to step S13.

In step S13, it is determined whether or not the temperature difference $\Delta t$ is smaller than a predetermined threshold t1. The threshold t1 is a positive value.

If it is determined "Yes", that is, if it is determined that $\Delta t < t1$ in step S13, it means that the final stage surface temperature has not been raised sufficiently, and steam will likely condense on the surface of the final stage stationary blade 10*a*. Therefore, the operation proceeds to step S4.

In contrast, if it is determined "No", that is, if $\Delta t \geq t1$ in step S13, it means that the final stage stationary blade surface temperature is raised sufficiently, and the possibility is low that steam condenses on the final stage stationary blade 10*a*. Therefore, the operation proceeds to step S5.

In step S14, the control device 31 increases the number of branched inlet passages which are opened, based on the temperature difference $\Delta t$. For example, when both of the control valves 45*a* and 45*b* are closed, either the control valve 45*a* or the control valve 45*b* is opened. As a result of this, the number of branched inlet passages through which part of the condensate flowing through the condensate channel 39 flows is increased, whereby the area of heat exchange surface in which the condensate flowing through the exchanger panel exchanges heat is increased.

The condensate introduced from the condensate inlet passage 55 exchanges heat with the outside of the heat exchanger panels 16*a* and 16*b*, that is, with steam within the space 14, while flowing through the inside of the heat exchanger panels 16*a* and 16*b*, whereby the condensate is heated and transformed into steam. The condensate, that has been transformed into steam in the heat exchanger panels 16*a* and 16*b*, is introduced into the heat carrier chamber 12 provided in the final stage stationary blade 10*a* through a stationary blade inlet passage (not shown in FIG. 5). The final stage stationary blade 10*a* is heated by the evaporated condensate being introduced into the heat carrier chamber 12.

Once step S14 is finished, the operation returns to step S11.

On the other hand, it is determined in step S15 whether or not $\Delta t$ is smaller than a predetermined threshold t2. The threshold t2 is set to a greater value than t1.

If it is determined "Yes" in step S15, that is, if $t2 < \Delta t$, it means that the final stage stationary blade surface temperature has been raised excessively. Therefore, the operation proceeds to step S16. If it is determined "No" in step S15, that is, if $t2 \geq \Delta t$, the operation returns to step S11.

In step S16, the number of branched inlet passages opened by the control device 31 is decreased. When both of the valves 45*a* and 45*b* are opened, either the valve 45*a* or the valve 45*b* is closed. As a result of this, the area of heat exchange surface in which the condensate flowing through the heat exchanger panels exchanges heat is reduced.

Once step S16 is finished, the operation returns to step S11.

During operation of the low-pressure steam turbine 1', the foregoing steps S11 to step S16 are repeated so that the area of the surface of the heat exchanger panel where the carrier (condensate) introduced into the heat carrier chamber 12 exchanges heat is regulated to thereby maintain the condition that $t1 \leq \Delta \leq t2$.

This makes it possible to prevent condensation of steam on the surface of the final stage stationary blade 10*a* and to realize reduction of wet loss and prevention of erosion.

Like the first embodiment, the stationary blade provided with the heat carrier chamber 12 into which condensate which is evaporated by being heated in the heat exchanger panels 16*a* and 16*b* is not limited to the final stage stationary blade. This means that, a heat carrier chamber may be provided in each of a plurality of stationary blades including the final stage stationary blade, so that the evaporated condensate is introduced into these heat carrier chambers.

Although, in the second embodiment, two heat exchanger panels are provided and the condensate inlet passage 55 is branched into two sub-branches, it is also possible that three or more heat exchanger panels are provided and the condensate inlet passage 55 is branched into the same number (three or more) as the number of the heat exchanger panels. As the number of heat exchanger panels and the number of sub-branches of the condensate inlet passage 55 become greater, the area of heat exchange surface can be regulated more precisely, but in this case the number of necessary control valves is also increased, resulting in increased manufacturing cost. Therefore, the number of heat exchanger panels and the number of sub-branches of the condensate inlet passage 55 must be determined in consideration of balance between the manufacturing cost and the regulation accuracy of the area of heat exchange surface.

The invention can be embodied in both the first and second embodiments by additionally providing a heat exchanger panel in a low-pressure steam turbine having an inner casing and an outer casing and a stationary blade is formed to have a heat carrier chamber so that a system to introduce a heat carrier into the heat exchanger panel is provided. This means that, the invention is applicable to existing equipment when a low-pressure steam turbine for this equipment is newly manufactured.

The low-pressure steam turbine according to the invention can be employed as a low-pressure steam turbine which is capable of reducing wet loss and preventing erosion by heating a stationary blade in the vicinity of the final stage without discharging driving steam together with drain and without the need of introducing energy from the outside.

The invention claimed is:

1. A low-pressure steam turbine comprising:

an inner casing housing a rotor having a plurality of moving blades fixed thereto, and including a plurality of stationary blades fixed in an inside of the inner casing;

an outer casing arranged outside the inner casing so as to cover the inner casing;

an exhaust chamber formed between the inner casing and the outer casing, and configured to flow an exhaust through a steam passage in the inner casing;

a heat carrier heating channel in the exhaust chamber, surrounding the inner casing so as to enable a heat carrier to flow therethrough, the heat carrier heating channel being configured to enable the heat carrier to be heated by heat exchange with steam outside the heat carrier heating channel;

a heat carrier inlet passage configured to introduce the heat carrier into the heat carrier heating channel; and a heat carrier chamber disposed in an inside of at least one of the stationary blades, and being configured to receive the heat carrier that has flowed through the heat carrier heating channel, wherein the at least one of the stationary blades in which the heat carrier chamber is disposed is configured to be heated by the heat carrier which has been heated by the heat exchange with the exhaust outside the heat carrier heating channel.

2. The low-pressure steam turbine according to claim 1, wherein the inner casing has a single-wall inner casing structure formed by a wall member, the stationary blades being supported via blade rings on an inside of the wall member.

3. The low-pressure steam turbine according to claim 1, wherein the at least one of the stationary blades in which the heat carrier chamber is disposed has a slit for injecting the heat carrier from the heat carrier chamber to the outside of the stationary blade; and the heat carrier is water, which is capable of being transformed into vapor by passing through the heat carrier heating channel and introduced into the heat carrier chamber.

4. The low-pressure steam turbine according to claim 1, wherein the heat carrier inlet passage is a condensate inlet passage configured to introduce, into the heat carrier heating channel, condensate obtained by condensing vapor which has been used to generate work in the low-pressure steam turbine, and the condensate is the heat carrier.

5. The low-pressure steam turbine according to claim 1, wherein the heat carrier heating channel surrounds an upper half of the inner casing.

6. The low-pressure steam turbine according to claim 1, wherein the heat carrier heating channel surrounds a steam inlet of the inner casing.

7. A low-pressure steam turbine, comprising:

a rotor having a plurality of moving blades fixed thereto;

an inner casing housing the rotor, and having a plurality of stationary blades fixed in the inside of the inner casing;

an outer casing arranged outside the inner casing so as to cover the inner casing;

a heat carrier heating channel between the inner casing and outer casing so as to enable a heat carrier to flow therethrough;

a heat carrier inlet passage configured to introduce the heat carrier into the heat carrier heating channel; and a heat carrier chamber disposed in an inside of at least one of the stationary blades, and being configured to receive the heat carrier that has passed through the heat carrier heating channel, wherein the at least one of the stationary blades in which the heat carrier chamber is disposed is configured to be heated by the heat carrier which has been heated by passing through the heat carrier heating channel, wherein the low-pressure steam turbine further comprises a stationary blade surface temperature detection unit configured to detect a surface temperature of the at least one of the stationary blades in which the heat carrier chamber is disposed;

a steam pressure detection unit configured to detect a steam pressure on the upstream side of the at least one of the stationary blades in which the heat carrier chamber is disposed; and a heat exchange amount regulating unit configured to regulate an amount of heat exchange based on a difference between a temperature detected by the stationary blade surface temperature detection unit and a saturated steam temperature at a detected pressure by the steam pressure detection unit.

8. The low-pressure steam turbine according to claim 7, wherein the heat exchange amount regulating unit comprises a heat carrier flow regulating valve disposed in the heat carrier inlet passage; and a regulating valve control unit configured to regulate opening of the heat carrier flow regulating valve based on the difference between the temperature detected by the stationary blade surface temperature detection unit and the saturated steam temperature at the detected pressure by the steam pressure detection unit.

9. The low-pressure steam turbine according to claim 7, wherein the heat carrier heating channel is one of a plurality of the heat carrier heating channels, the heat carrier inlet passage branches midway into a plurality of branched inlet passages, the plurality of branched inlet passages being connected to the plurality of heat carrier heating channels, and the heat exchange amount regulating unit comprises branched inlet passage heat carrier flow regulating valves disposed in the branched inlet passages, and a branched passage regulating valve control unit configured to regulate opening of the branched inlet passage heat carrier flow regulating valves based on the difference between the temperature detected by the stationary blade surface temperature detection unit and the saturated steam temperature at the detected pressure by the steam pressure detection unit.

* * * * *